US005823922A

United States Patent [19]

Eckmann

[11] Patent Number: 5,823,922

[45] Date of Patent: Oct. 20, 1998

[54] DUMBBELL

[75] Inventor: James A. Eckmann, Libertyville, Ill.

[73] Assignee: Sportworks Ltd., Vernon Hills, Ill.

[21] Appl. No.: 844,941

[22] Filed: Apr. 23, 1997

[51] Int. Cl.[6] ..... A63B 21/072

[52] U.S. Cl. ..... 482/108; 482/105; 482/44

[58] Field of Search ..... 482/44, 74, 105, 482/106, 108; 280/821

[56] References Cited

U.S. PATENT DOCUMENTS

| | | | |
|---|---|---|---|
| D. 291,587 | 8/1987 | Wu | D21/682 |
| D. 297,962 | 10/1988 | Wu | D21/682 |
| 734,062 | 7/1903 | Harris | 482/108 |
| 3,482,834 | 12/1969 | James, Jr. . | |
| 3,734,493 | 5/1973 | Hasekian | 482/108 |
| 3,992,021 | 11/1976 | Tobin | 280/821 |
| 4,351,526 | 9/1982 | Schwartz | 482/108 |
| 4,493,494 | 1/1985 | Feagin, Jr. | 280/821 |
| 4,703,927 | 11/1987 | Hanzlik | 482/108 |
| 4,743,017 | 5/1988 | Jaeger | 482/108 |
| 4,773,640 | 9/1988 | Kolbel et al. . | |
| 4,787,624 | 11/1988 | Grant | 482/108 |
| 5,131,898 | 7/1992 | Panagos | 482/108 |
| 5,135,455 | 8/1992 | King et al. | 482/108 |
| 5,242,350 | 9/1993 | Chang . | |
| 5,428,514 | 6/1995 | Fink, Jr. | 482/108 |
| 5,518,478 | 5/1996 | Liang . | |
| 5,580,343 | 12/1996 | Cafiero . | |

FOREIGN PATENT DOCUMENTS

| | | | |
|---|---|---|---|
| 5648 | 3/1884 | United Kingdom | 482/108 |
| 3268 | 9/1987 | United Kingdom | 482/108 |

OTHER PUBLICATIONS

Heavyhands, AMF Industries, advertisement in The Washington Post, Feb. 17, 1983, p. A39, Feb. 1983.

*Primary Examiner*—Richard J. Apley
*Assistant Examiner*—Victor K. Hwang
*Attorney, Agent, or Firm*—Polster, Lieder, Woodruff & Lucchesi LC

[57] ABSTRACT

A dumbbell made of heavy material has a central bar, weight knobs at opposite ends of the bar and a guard-handle spaced from the bar a distance to allow the insertion of a user's fingers between the guard-handle and the bar, the bar, weight knobs, and guard-handle being one piece. Preferably, the dumbbell is made of cast iron and coated with a resilient coating. In another embodiment, the guard handle has a center span with a long reach and a short reach, spaced axially from one another to define a belt-receiving gap.

7 Claims, 5 Drawing Sheets

DUMBBELL

CROSS-REFERENCE TO RELATED APPLICATIONS

This application is a continuation in part of co-pending application Ser. No. 29/053,057, filed Apr. 16, 1996.

STATEMENT REGARDING FEDERALLY SPONSORED RESEARCH OR DEVELOPMENT

Not Applicable.

BACKGROUND OF THE INVENTION

Dumbbells as exercise devices have been used for many years. Ordinarily, they consist of a bar with a spherical weight at each end. With the advent of "power walking", in which weights held in the hands are used to supplement the exercise benefit of walking, it has been desirable to reduce the dimensions of the dumbbell.

Dumbbells with a core of heavy material have been suggested heretofore (see U.S. Pat. No. 3,482,834, which discloses a core of cementitious material); dumbbells with polygonal weights have been disclosed (see U.S. Pat. No. 5,171,199, showing a dumbbell with weights that are square in end elevation), and weights with handles of sorts (see U.S. Pat. No. 5,242,350 or U.S. Pat. No. 5,518,478). None has shown or suggested either alone or in combination, a dumbbell having a bar and a handle cast in one-piece, and made of a heavy material, preferably, cast iron. None shows such a dumbbell with polygonal weights on either end of the bar, cast in one piece with the handle and bar, nor such a handle with a gap in it to admit a belt of the user.

A hand weight that is compact and heavy and that requires the user to grip it continuously is liable to cause excessive fatigue and even carpal tunnel syndrome with continued use.

One of the objects of this invention is to provide a dumbbell that is compact and easy to use.

Another object is to provide such a dumbbell that need not be gripped tightly continuously by the user.

Other objects will become apparent to those skilled in the art in light of the following description and accompanying drawings.

BRIEF SUMMARY OF THE INVENTION

In accordance with this invention, generally stated, a dumbbell is provided made of heavy material, preferably cast iron, the dumbbell having a central bar and a guard-handle spaced from the bar a distance to allow the insertion of a user's fingers between the guard-handle and the bar, the bar and guard-handle being all in one piece. In the preferred embodiment, weight knobs are provided at opposite ends of the bar, cast in one piece with the bar and handle. Preferably, the weight knobs are polygonal, with apices aligned with one another across the bar, and the handle is aligned with an apex of the two weight knobs, so that when the dumbbell is set on a flat surface, the handle tends at an acute angle to the surface in one direction, and an obtuse angle in the other direction. In this way, the fingers of the user can always easily be slid between the bar the handle toward the side of the acute angle to pick up the dumbbell by the bar. Also, if it is desired to pick up two weights by the handle with one hand, they can be set down with the handles facing one another, and easily be picked up at the same time.

In another embodiment, which can but need not include the weight knobs, the handle, which is cast in one piece with the bar, has a belt-receiving gap in it.

Preferably, the cast iron core is covered with a resilient coating, to insulate the cast iron from the hand of the user, to minimize the danger of injury, and to enhance the appearance of the dumbbell. Further to minimize the danger of injury, the various edges of the dumbbell are rounded.

The design of handle of the dumbbell is such that in use, the bar can be held perpendicular to the floor, when the weight can rest on the hand between the thumb and forefinger, thus enabling the dumbbell to be used without having to grip the dumbbell firmly. In this posture, fatigue and stress on the muscles of the hand are greatly reduced, and the risk of carpal tunnel syndrome accordingly reduced. In the embodiment of dumbbell in which the handle has a belt-receiving gap, the dumbbell can be hung from the belt as a relief from carrying the dumbbell in the hand.

DETAILED DESCRIPTION OF THE INVENTION

Figure 1:
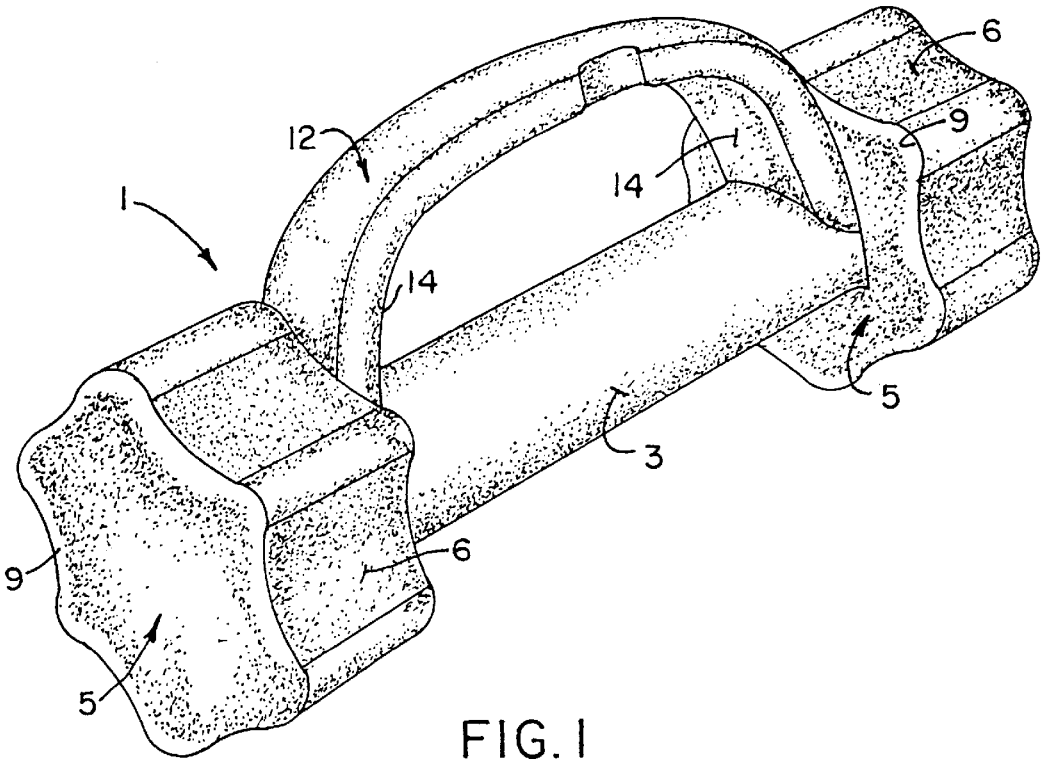
FIG. 1 is a view in perspective of one embodiment of the dumbbell of this invention.
Figure 2:
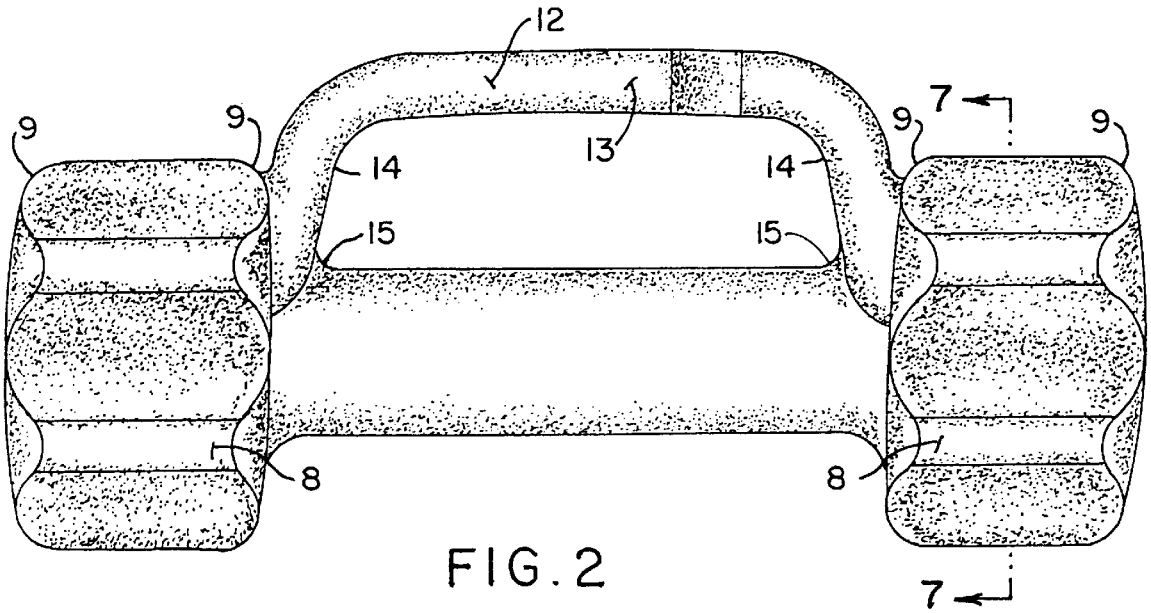
FIG. 2 is a view in side elevation.
Figure 3:
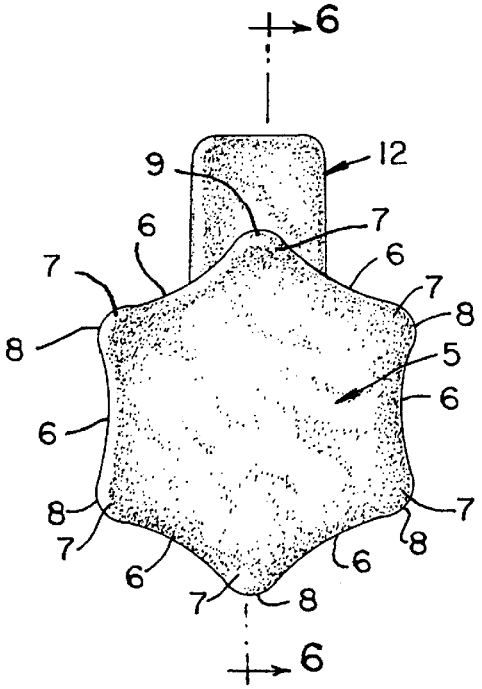
FIG. 3 is a view in end elevation.
Figure 4:
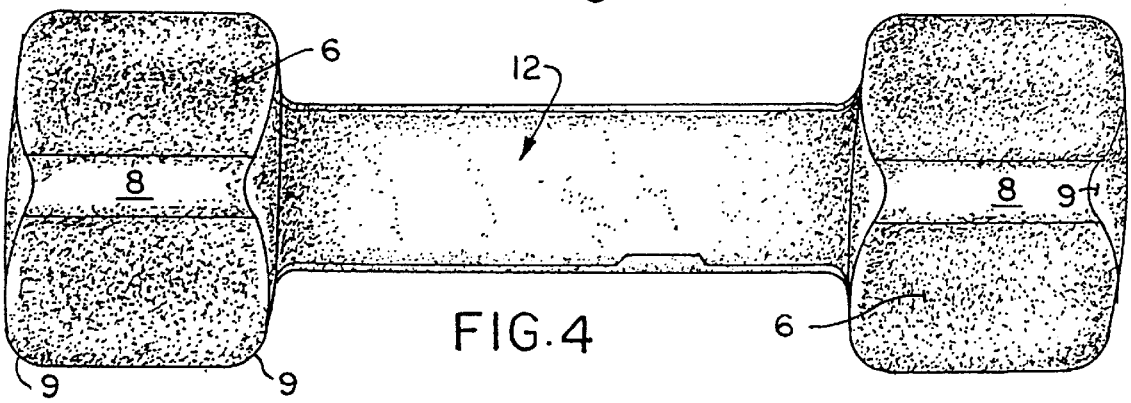
FIG. 4 is a top plan view.
Figure 5:
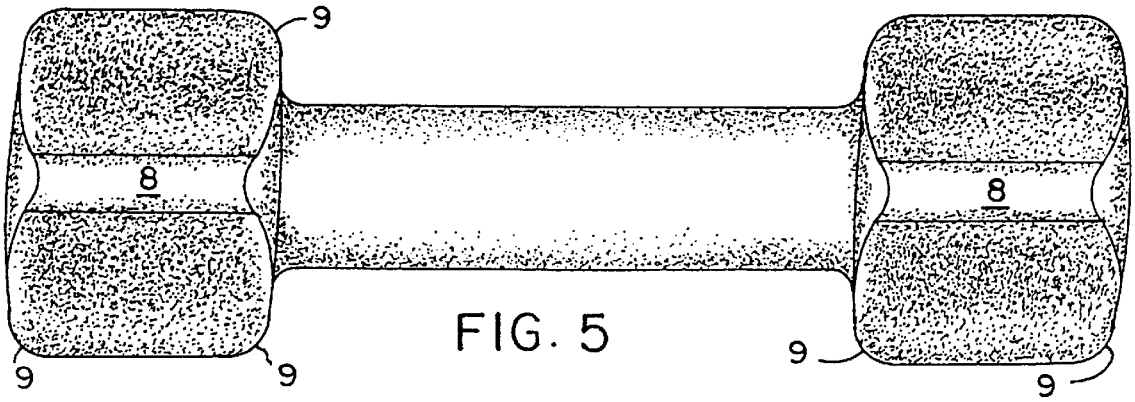
FIG. 5 is a bottom plan view.
Figure 6:
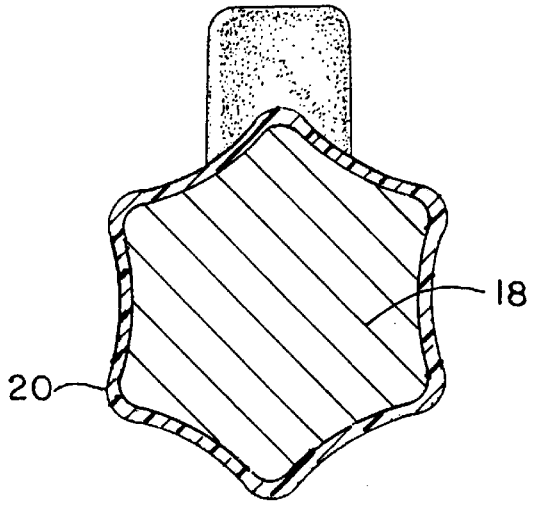
FIG. 6 is a sectional view taken along the line 7—7 of FIG. 2.
Figure 7:
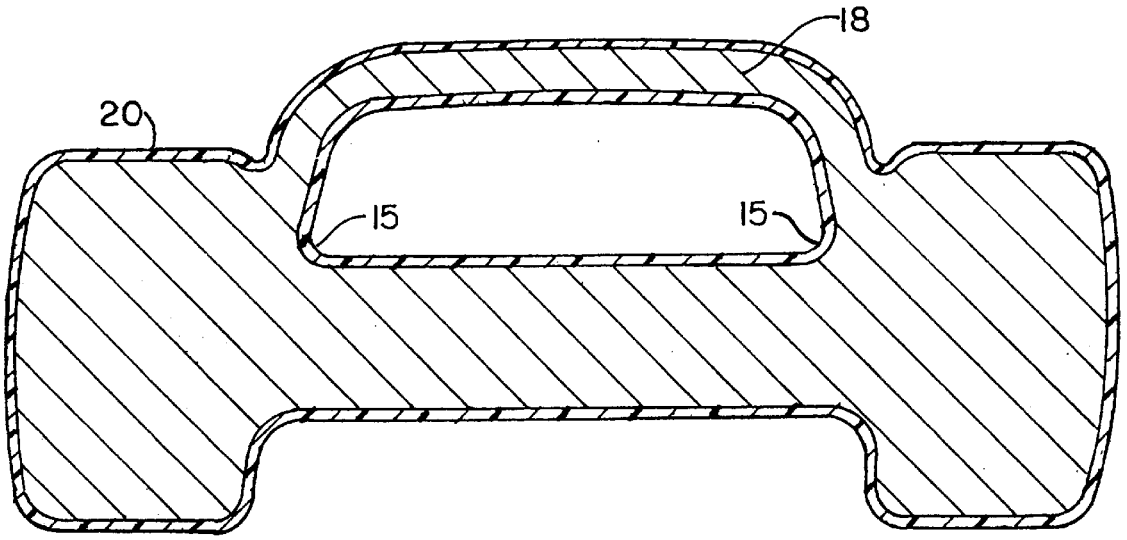
FIG. 7 is a sectional view taken along the line 6—6 of FIG. 3.

Referring now to FIGS. 1–7 of the drawings for a preferred embodiment of this invention, reference numeral 1 indicates a finished dumbbell. The dumbbell 1 has a central cylindrical, two-ended bar 3, weight knobs 5 on either end of the bar, and a guard-handle 12.

The weight knobs in the illustrative embodiment shown, are hexagonal, with six peaks 7. The peaks 7 extend the axial lengths of the knobs, and the peaks of the two knobs are aligned in the axial direction of the bar. The peaks 7 have rounded apices 8, and rounded side edges 9. Between successive peaks, are curved valleys 6.

The guard-handle 12 has a generally flat center span 13 and legs 14, which meet the flat center span in rounded corners or coves 15. The legs meet the bar and the weight knobs in a cove at the juncture of the weight knobs and bar. A longitudinal center line (along the line 6—6 of FIG. 3) of the handle is aligned with aligned peaks of the knobs 5, as shown in FIGS. 3, 4, 6 and 7.

The dumbbell is made up of a core 18, in this illustrative example, of cast iron, all of a piece. The core 18 is covered with a plastic, resilient cover or coat 20.

Merely by way of example, a five pound weight can be 8" long between outboard surfaces of the knobs 5, the bar 3 can be 1⅛" in diameter, and the knobs 5, from peak to opposite peak, 3" in diameter and from valley to opposite valley, 2¼". The handle 12 can be ⅜" thick and spaced through the center span 13, 1⅛" from the nearest surface of the bar 3, and extend 3¼" between the points at which it meets the bar, inside surface to inside surface, the clearance between the handle and bar, and between the legs of the handle, being sufficient to permit easy access of fingers 40. The distance between the inboard surfaces of the knobs 5 can be 4½", and the knobs themselves, 1¾" from the outboard surface to the inboard surface of each knob. As seen particularly in FIGS. 2 and 7, the meeting areas of the handle and bar, like the meeting areas of the center span and legs of the handle, meet in a cove to ensure that letting the dumbbell hang between the thumb and forefinger will be comfortable. The dumbbell is coated with a resilient material such as polyurethane, or Neoprene, preferably pigmented, and it can be flocked.

The provision of the valleys between the peaks of the knobs makes the dumbbell more stable at rest than if the reaches were flat, any three points on the two knobs resting on a surface 45 defining a plane, as well as giving the dumbbell a pleasing appearance.

Figure 8:
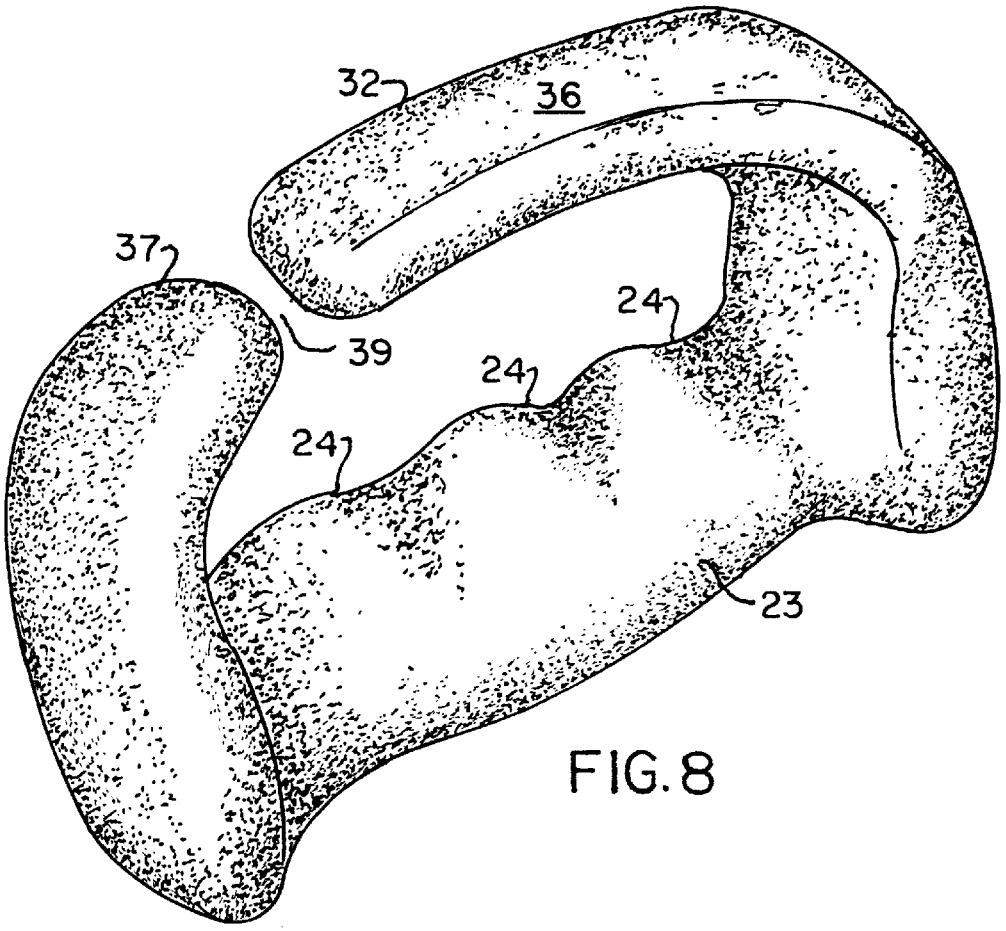
FIG. 8 is a view in perspective of a second embodiment, in which the handle has a belt-receiving gap in it.
Figure 9:
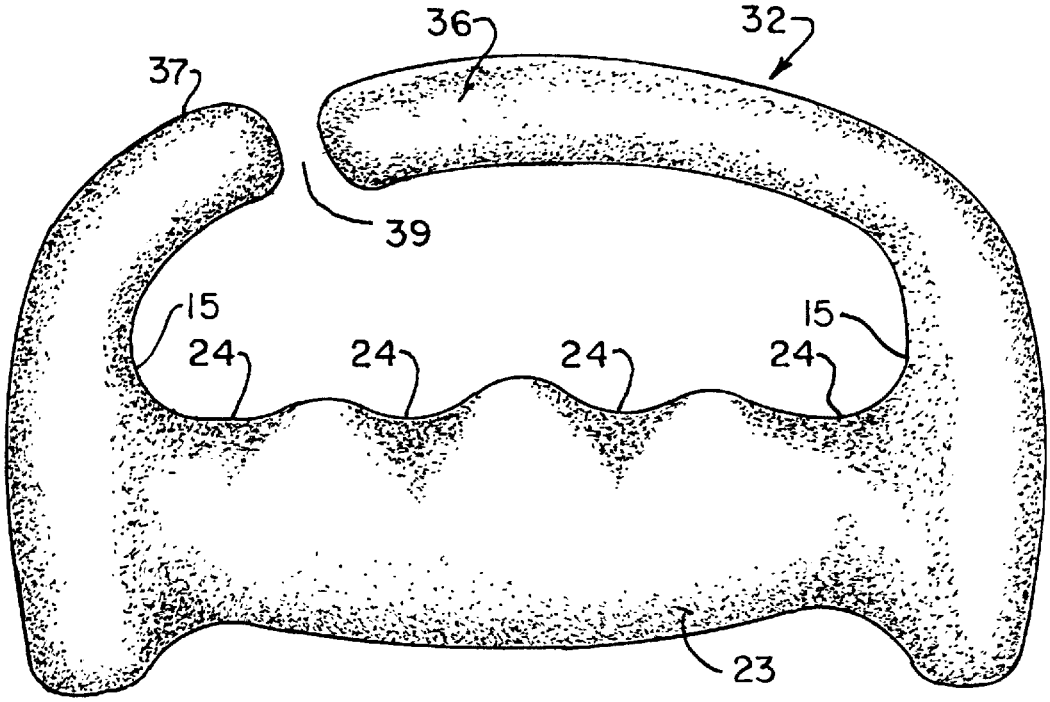
FIG. 9 is a view in side elevation of the dumbbell shown in FIG. 8.
Figure 11:
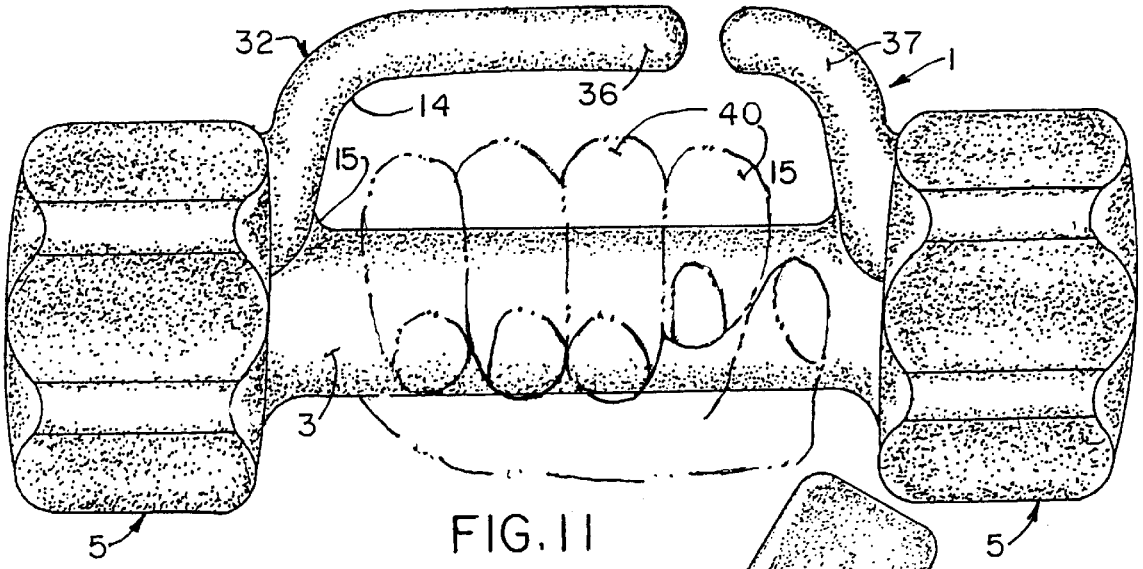
FIG. 11 is a view in side elevation of a dumbbell similar to the one shown in FIGS. 1 and 10 but with a gap in the handle showing, in phantom lines, a hand gripping the center span of the dumbbell.
Figure 10:
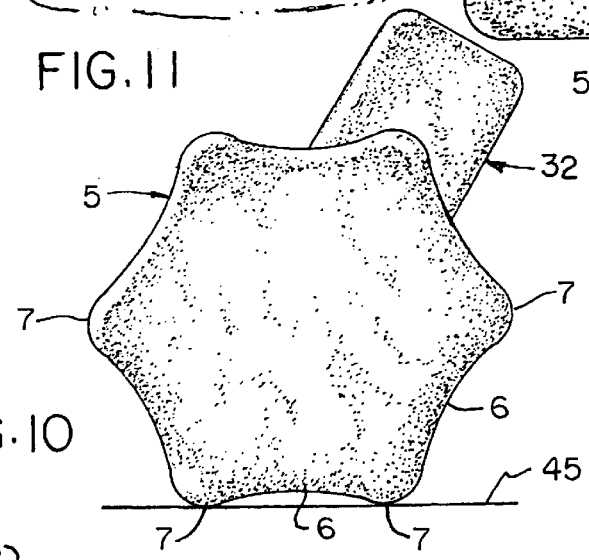
FIG. 10 is a view in end elevation showing the dumbbell of FIG. 1 at rest on a flat surface.
Figure 12:
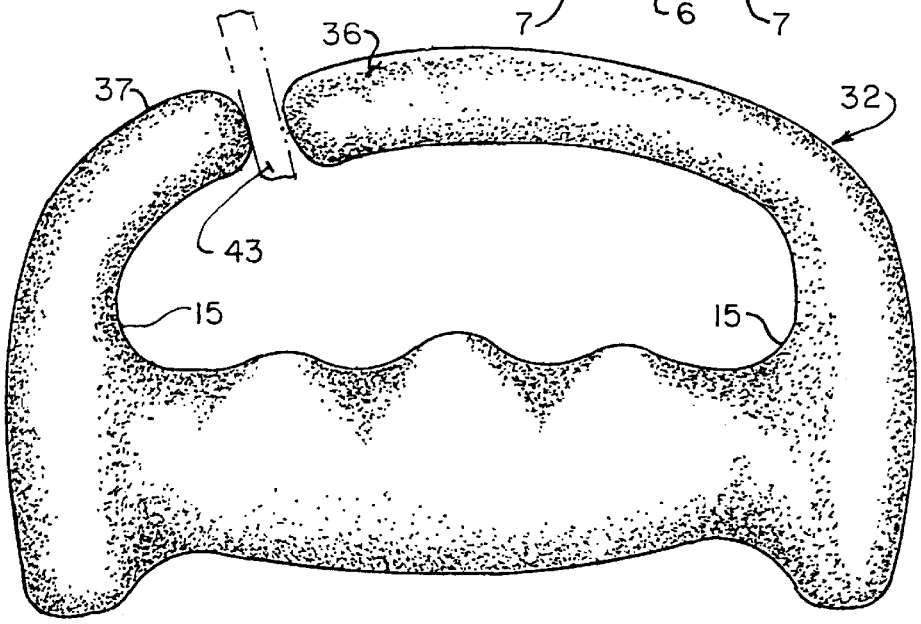
FIG. 12 is a view in side elevation of the dumbbell shown in FIGS. 8 and 9, showing a belt, in phantom lines, being inserted in the gap between reaches of a handle.

In the embodiment shown in FIGS. 8 and 9, without the knobs 5, the dumbbell weighs two pounds, as against five with the weights. In this embodiment, a bar 23, with finger recesses 24, is cast in one piece with a handle 32. A center span of the handle 32 has a long reach 36 and a short reach 37, and between the two reaches, a gap 39. The short reach 37 serves as a hook for a belt 43 of a user, the belt being passed through the gap 39. The dimensions of the bar and handle, except for the gap, can be the same as the illustrative dimensions given for the first embodiment. The gap can be on the order of ¼" wide at its narrowest dimension, the edges defining the gap being rounded, both to facilitate the entrance of the belt and to protect the user. The dumbbell of this invention is also coated with a resilient material.

Numerous variations in the construction of the dumbbell of this invention, within the scope of the appended claims, will occur to those skilled in the art in the light of the foregoing disclosure. By way of example, the weight knobs can be differently configured, although it is desirable that a flat or arched surface be so oriented with respect to the handle as to provide an angular arrangement of the handle when the dumbbell is at rest. An iron- or other heavy material-filled plastic, or a different metal can be used as the core material, as long as it can be formed in one piece, has the requisite strength at the handle section, is non-toxic, durable, will not shatter when dropped and is economical to manufacture. For ease of manufacture, durability, strength, stability as to shape, and economy, cast iron is the preferred material. Different coating materials can be used to provide a rubbery surface. The embodiment with the gap in the center span of the handle can be provided with weight knobs as in the first embodiment, although the configuration of the weight knobs can, if desired, be varied to make attachment to the belt easier. These are merely illustrative.

I claim:

1. A dumbbell made of rigid material, said dumbbell having a central bar, and a rigid, inflexible guard-handle spaced from said bar a distance to allow the insertion of a user's fingers between said guard-handle and said bar, said handle having a center span with a long reach and a short reach spaced axially from one another to define a gap, said short reach defining a hook by which said dumbbell can be mounted removably on a belt of a user.

2. A dumbbell made of one-piece cast iron, said dumbbell having a central bar, and a guard-handle spaced from said bar a distance to allow the insertion of a user's fingers between said guard-handle and said bar, said bar and handle being one piece, said handle having a center span with a long reach and a short reach spaced axially from one another to define a gap, said short reach defining a hook by which said dumbbell can be mounted removably on a belt of a user.

3. A one-piece cast iron dumbbell comprising a central bar, weight knobs at opposite ends of said bar, and a guard handle spaced from said central bar a distance to allow the insertion of a user's fingers between said guard handle and said central bar, said weight knobs being uniformly polygonal, with peaks and between said peaks, valleys, said dumbbell resting on two peaks at at least one end when on a flat supporting surface, said guard handle being oriented with respect to said peaks to extend at an acute angle to the horizontal when said dumbbell is at rest on said flat surface.

4. The dumbbell of claim 3 wherein said peaks are rounded.

5. The dumbbell of claim 3 wherein the weight knobs are hexagonal in end elevation.

6. The dumbbell of claim 3 wherein said guard handle has a center span and, at each end of said center span, legs which join at outer ends of said legs to said bar at an inboard side of said weight knobs, meeting areas of said legs with said bar and with said center span of said handle being coved.

7. The dumbbell of claim 3 wherein said guard handle has a center span with a short reach and a long reach spaced axially to define between them a gap sufficiently wide to receive a belt of a user.

* * * * *